US007155913B2

(12) United States Patent
Beule et al.

(10) Patent No.: US 7,155,913 B2
(45) Date of Patent: Jan. 2, 2007

(54) TURBOMACHINE ANNULAR COMBUSTION CHAMBER

(75) Inventors: Frederic Beule, Brunoy (FR); Michel Desaulty, Vert Saint Denis (FR)

(73) Assignee: Snecma Moteurs, Paris (FR)

( * ) Notice: Subject to any disclaimer, the term of this patent is extended or adjusted under 35 U.S.C. 154(b) by 111 days.

(21) Appl. No.: 10/866,695

(22) Filed: Jun. 15, 2004

(65) Prior Publication Data

US 2005/0042076 A1 Feb. 24, 2005

(30) Foreign Application Priority Data

Jun. 17, 2003 (FR) ..... 03 50226

(51) Int. Cl.
*F02C 3/06* (2006.01)
*F02C 3/14* (2006.01)

(52) U.S. Cl. ..... 60/804; 60/754

(58) Field of Classification Search ..... 60/752–760, 60/804

See application file for complete search history.

(56) References Cited

U.S. PATENT DOCUMENTS 2,974,485 A * 3/1961 Schiefer ..... 60/756
3,751,911 A 8/1973 Tartaglia
3,990,837 A * 11/1976 Snell ..... 60/752
4,194,358 A * 3/1980 Stenger ..... 60/776
4,244,178 A * 1/1981 Herman et al. ..... 60/754
4,246,758 A * 1/1981 Caruel et al. ..... 60/747
4,896,510 A * 1/1990 Foltz ..... 60/757
5,142,871 A * 9/1992 Lampes et al. ..... 60/756
5,154,060 A * 10/1992 Walker et al. ..... 60/746
5,197,278 A * 3/1993 Sabla et al. ..... 60/773
5,197,289 A * 3/1993 Glevicky et al. ..... 60/746
5,220,795 A * 6/1993 Dodds et al. ..... 60/747
5,285,635 A * 2/1994 Savelli et al. ..... 60/804
5,289,687 A * 3/1994 Kress et al. ..... 60/747
5,321,951 A * 6/1994 Falls et al. ..... 60/748
5,329,761 A * 7/1994 Ablett et al. ..... 60/804
5,331,805 A 7/1994 Myers et al.
5,353,587 A * 10/1994 Halila ..... 60/39.37
5,375,420 A * 12/1994 Falls et al. ..... 60/747
5,417,069 A * 5/1995 Alary et al. ..... 60/747
5,421,158 A * 6/1995 Stenger et al. ..... 60/747
5,528,896 A * 6/1996 Alary et al. ..... 60/804
5,623,827 A * 4/1997 Monty ..... 60/748
5,775,108 A 7/1998 Ansart et al.
5,970,716 A * 10/1999 Forrester et al. ..... 60/746

(Continued)

FOREIGN PATENT DOCUMENTS

EP 1 010 944 6/2000

(Continued)

*Primary Examiner*—William Rodriguez
(74) *Attorney, Agent, or Firm*—Oblon, Spivak, McClelland, Maier & Neustadt, P.C.

(57) ABSTRACT

The invention relates to a turbomachine annular combustion chamber (1) comprising an outer axial wall (2), an inner axial wall (4), and a chamber bottom end (8) connecting the said walls, the chamber bottom end being provided with several passages (34,36,72) enabling initiation of a cooling air film (D2) along the hot inner surface (30) of the outer axial wall and initiation of a cooling air film (D1) along the hot inner surface (32) of the inner axial wall, the outer axial wall and the inner axial wall being multi-perforated roughly over their full length in order to enable reinforcement of the cooling air films. According to the invention, the outer axial wall and the inner axial wall are provided, in an upstream part, with a first zone (54,40) of perforations (38) formed such that cooling air is introduced inside the combustion chamber in reverse flow.

20 Claims, 1 Drawing Sheet

U.S. PATENT DOCUMENTS

| | | | | | |
|---|---|---|---|---|---|
| 5,974,805 | A | * | 11/1999 | Allen | 60/740 |
| 6,058,710 | A | * | 5/2000 | Brehm | 60/747 |
| 6,079,199 | A | * | 6/2000 | McCaldon et al. | 60/800 |
| 6,145,319 | A | * | 11/2000 | Burns et al. | 60/755 |
| 6,155,055 | A | * | 12/2000 | Forestier | 60/747 |
| 6,155,056 | A | * | 12/2000 | Sampath et al. | 60/756 |
| 6,260,359 | B1 | * | 7/2001 | Monty et al. | 60/752 |
| 6,279,323 | B1 | * | 8/2001 | Monty et al. | 60/752 |
| 6,474,070 | B1 | * | 11/2002 | Danis et al. | 60/739 |
| 6,655,146 | B1 | * | 12/2003 | Kutter et al. | 60/752 |
| 6,655,149 | B1 | * | 12/2003 | Farmer et al. | 60/754 |

FOREIGN PATENT DOCUMENTS

| | | |
|---|---|---|
| GB | 2 021 204 | 11/1979 |
| GB | 2 073 396 | 10/1981 |
| GB | 2 099 978 | 12/1982 |

* cited by examiner

TURBOMACHINE ANNULAR COMBUSTION CHAMBER

TECHNICAL FIELD

This invention generally relates to the domain of turbomachine annular combustion chambers and more particularly to the field of means for providing thermal protection for these combustion chambers.

STATE OF PRIOR ART

Typically, a turbomachine annular combustion chamber comprises an outer axial wall and an inner axial wall, these walls being arranged coaxially and connected to each other through a chamber bottom end.

The shape of the bottom end of the combustion chamber is also annular, and the combustion chamber is provided with injection orifices, each of which will receive a fuel injector to enable combustion reactions inside this combustion chamber. It is noted that these injectors can also be used to add at least part of the air intended for combustion, in a primary zone in the combustion chamber located on the upstream side of a secondary zone called the dilution zone.

In this respect, note that apart from required air needs to perform combustion reactions inside the primary zone of the combustion chamber, the combustion chamber also requires dilution air usually added through dilution orifices formed on the outer and inner axial walls, and also cooling air to protect all component elements of the combustion chamber.

According to a conventional embodiment according to prior art, the chamber bottom end is provided with several passages to allow cooling air to pass through to the inside of the combustion chamber. It is mentioned that these passages can be formed on deflectors fitted on the chamber bottom end, these deflectors also called dishes or heat shields, may be provided in order to provide protection against thermal radiation.

These passages are usually designed so as to enable initiation of a cooling air film along the hot inner surface of the outer axial wall, and initiation of a cooling air film along the hot inner surface of the inner axial wall.

Moreover, in order to reinforce these cooling air films initiated on the upstream side of the outer and inner axial walls, each must be made so as to present a multi-perforation roughly over their full length. In this way, cooling air from the axial walls may be added inside the combustion chamber along the length of these axial walls, in order to achieve relatively uniform and high performance cooling. Naturally, this multi-perforation is obtained by forming orifices all around the axial walls concerned, and over most of their length.

However, although combustion chambers of this type have a relatively high performance, they do have some major disadvantages related to the uniform axial wall temperatures criterion.

The circumferential homogeneity of cooling air films initiated at the chamber bottom end are relatively mediocre, particularly when the chamber bottom end is fitted with deflectors. Moreover, the characteristics of these films are likely to change with time, mainly due to progressive deformation of the elements making up the chamber bottom end.

Consequently, when the thermal load in the combustion chamber is very high, these disadvantages may result in the appearance of hot points, particularly in an upstream part of the outer and inner axial walls, these hot points naturally inducing a non-negligible reduction in the life of combustion chamber.

Moreover, during tests carried out on such a combustion chamber, experience has shown that there is a hot parietal zone in the first upstream circumferential rows of perforations in each of outer and inner axial walls.

Tests carried out have also shown that the appearance of this type of hot parietal zone is largely caused by trapping of cooling air films, initiated from the chamber bottom end, between the axial wall concerned and the cooling air layer originating from the multi-perforation formed on this same wall.

Consequently, it is quite obvious from these observations that with the design of these combustion chambers, it is impossible to obtain satisfactorily uniform temperatures in the axial walls.

Finally, it is shown that the presence of primary orifices and dilution orifices on the outer and inner axial walls leads to local suction of cooling air films. Thus, the consequence of this is to generate a sudden drop in the adiabatic efficiency on the downstream side of these orifices, and therefore cause the appearance of additional hot points.

OBJECT OF THE INVENTION

Therefore, the purpose of the invention is to propose an annular turbomachine combustion chamber, at least partially overcoming the disadvantages mentioned above related to embodiments according to prior art.

More precisely, the object of the invention is to present an annular turbomachine combustion chamber, with a design that enables more uniform axial wall temperatures than are possible in embodiments according to prior art.

To achieve this, the object of the invention is a turbomachine annular combustion chamber comprising an outer axial wall, an inner axial wall and a chamber bottom end connecting the axial walls, the chamber bottom end being provided firstly with several injection orifices that will be used at least to inject fuel inside the combustion chamber, and also passages allowing at least the initiation of a cooling air film along the hot inner surface of the outer axial wall and of a cooling air film along the hot inner surface of the inner axial wall, the outer and inner axial walls being multi-perforated roughly over their full length in order to enable reinforcement of the cooling air films. According to the invention, each of the outer and inner axial walls is provided with a first zone of perforations in the upstream part formed such that cooling air is introduced inside the combustion chamber in reverse flow.

Advantageously, the specific design of the combustion chamber according to the invention is such that very uniform axial wall temperatures can be obtained, enabling significant thickening of cooling air films initiated from the chamber bottom end, this thickening being made close to the bottom end.

Effectively, introduction of the cooling air film in reverse flow near the upstream part of the outer and inner axial walls eliminates hot parietal zones that occur in embodiments according to prior art near the first rows of perforations of each of these outer and inner axial walls.

Similarly, it has been observed that problems related to circumferential non-uniformity of cooling air films initiated at the chamber bottom end, and problems related to the variation of the characteristics of these films with time, were largely attenuated following the addition of this type of reverse flow inside the combustion chamber.

Consequently, the specific arrangement made provides a means of obtaining a longer life combustion chamber, and therefore enables a reduction in the cooling flow that directly improves temperature maps and pollution performances.

More generally, it is noted that combining a multi-perforation with reverse flow and a multi-perforation with co-current flow, permits to generate a cooling film with high efficiency over the entire surface of the axial wall concerned, both circumferentially and longitudinally.

Preferably, each perforation in the first zone of the outer axial wall is formed such that in an axial half-section, the value of the angle formed between a local direction tangential to the outer axial wall in this half-section and a principal direction of the perforation in the same half-section, is between about 30° and 45°. Similarly, each perforation in the first zone of the inner axial wall is formed such that in an axial half-section, the value of the angle formed between a local direction tangential to the inner axial wall in this half-section, and a principal direction of the perforation in this same half-section, is between about 30° and 45°.

Preferably, each of the outer and inner axial walls is provided with a second zone of perforations on the downstream side of the first zone of perforations, formed such that the cooling air is introduced in the direction of the flow inside the combustion chamber.

With this arrangement, it is then possible that each of the outer and inner axial walls can be provided with a transition perforations zone between the first perforation zone and the second perforation zone, designed to enable a progressive change in the direction in which cooling air is introduced inside the combustion chamber.

In the case in which the chamber bottom end has an inter-heads wall, it will be possible for this wall to comprise (in order from the upstream side to the downstream side) a first zone of perforations formed such that the cooling air is introduced in reverse current inside the combustion chamber, a transition perforations zone, and a second zone of perforations formed such that the co-current cooling air flow is introduced in this combustion chamber.

Also preferably, the chamber is designed such that the outer and inner axial walls each comprise several primary orifices and dilution orifices, a local perforations area formed such that cooling air is introduced locally with reverse current inside the combustion chamber then being provided on the downstream side of each of these primary orifices, and on the downstream side of each of these dilution orifices.

Advantageously, the presence of these local perforation zones provides a means of completely eliminating hot points encountered on the downstream side of each of the primary and dilution orifices in previous embodiments.

Other advantages and characteristics of the invention will become clear in the non-limitative detailed description given below.

BRIEF DESCRIPTION OF THE DRAWINGS

This description will be made with reference to the single FIGURE showing a partial view of an axial half-section through a turbomachine annular combustion chamber according to a preferred embodiment of this invention.

DETAILED DESCRIPTION OF A PREFERRED EMBODIMENT

Figure 1:
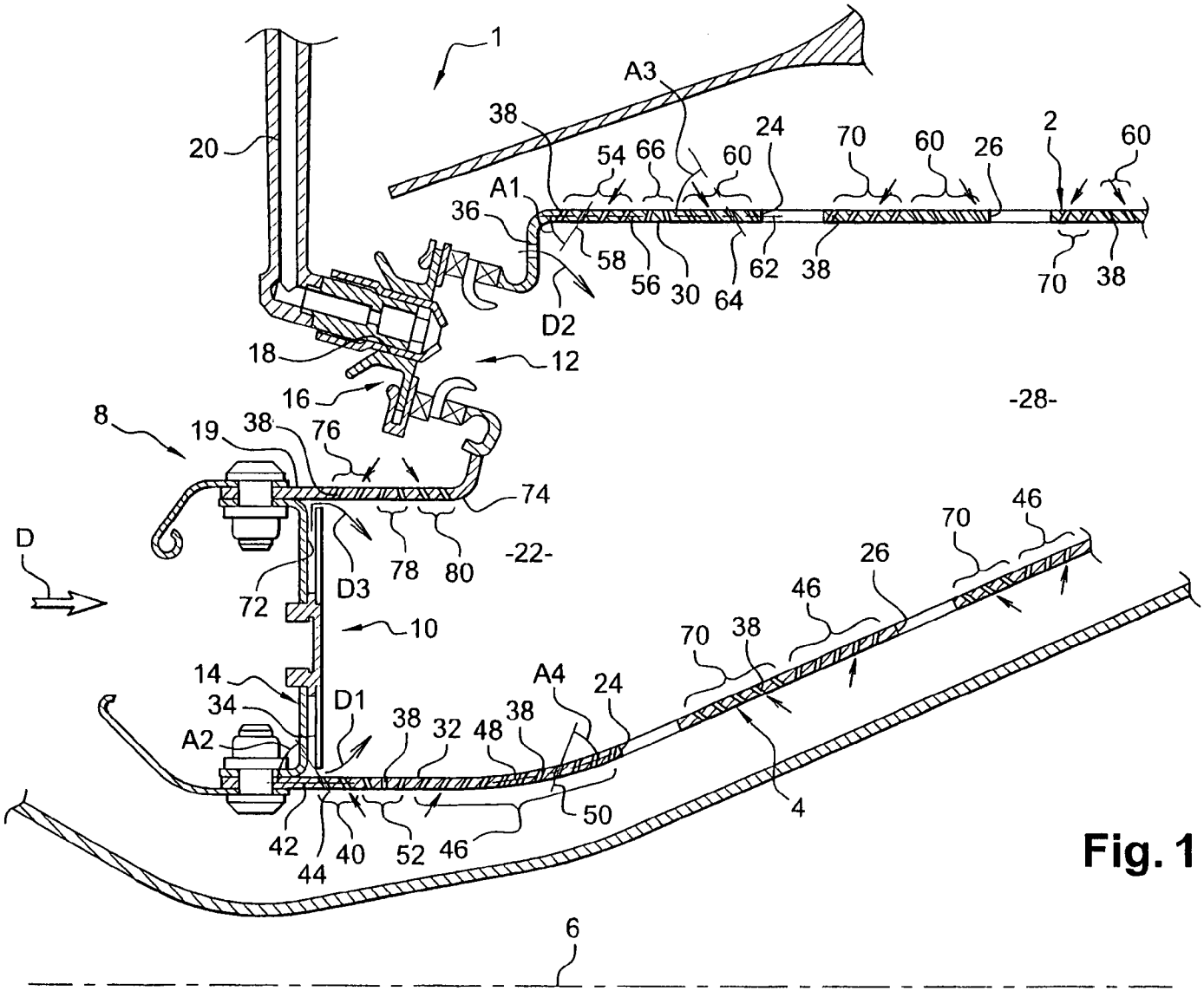

With reference to the single figure, the figure partially shows an annular combustion chamber 1 of a turbomachine according to a preferred embodiment of this invention.

The combustion chamber 1 comprises an outer axial wall 2 and an inner axial wall 4, these two walls 2 and 4 being arranged coaxially along a longitudinal principal axis 6 of the chamber 1, this axis 6 also corresponding to the longitudinal principal axis of the turbomachine.

The axial walls 2 and 4 are connected to each other through a chamber bottom end 8, which in the preferred embodiment described comprises a pilot head 10 and a separation head 12. As can be seen in the figure, the separation head 12 is axially offset in the downstream direction, and is radially offset outwards from the pilot head 10. Moreover, these heads 10 and 12 connected to each other through an inter-heads wall 19, are provided with a deflector 14 and a deflector 16 respectively. Obviously, this chamber bottom end 8 could be designed differently in a manner known to an expert in the subject, for example in which it does not have a deflector, without going outside the scope of the invention.

Several injection orifices 18, preferably cylindrical shaped with a circular cross-section, are formed on each of the deflectors 14 and 16 in the chamber bottom end 8, so as to be spaced at angular intervals. Each of these injection orifices 18 is designed to cooperate with a fuel injector 20, to enable combustion reactions inside this combustion chamber 1 (since the injection orifices 18 of the deflectors 14 and 16 are staggered, the axial half-sectional view in FIG. 1 only shows one injection orifice 18 and one injector 20 of the separation head 12).

Note that these injectors 20 are also designed so that at least part of the air intended for combustion can be introduced, within a primary zone 22 located in an upstream part of the combustion chamber 1. It is also indicated that air intended for combustion can also be added inside the chamber 1 through primary orifices 24 located all around the external axial wall 2 and the inner axial wall 4. As can be seen in the single figure, the primary orifices 24 are arranged upstream from a number of dilution orifices 26, which are also placed all around the outer axial wall 2 and the inner axial wall 4, with the main function being to enable air supply to a dilution zone 28 located on the downstream side of the primary zone 24.

It is also specified that another part of the air added into the combustion chamber 1 is in the form of a cooling air flow D, used mainly to cool the hot inner surfaces 30 and 32 of the outer axial wall 2 and the inner axial wall 4.

To achieve this, the deflector 14 of the pilot head 10 comprises a passage 34 for the introduction of part of the cooling air flow D inside the combustion chamber 1, close to the inner axial wall 4.

In this way, the passage 34 then enables initiation of a cooling air film D1 along the hot inner surface 32 of the inner axial wall 4.

Similarly, the deflector 16 of the separation head 12 comprises a passage 36 enabling introduction of another part of the cooling air flow D inside the combustion chamber 1 close to the outer axial wall 2. Consequently in this configuration, the passage 36 enables initiation of a cooling air flow D2 along the hot inner surface 30 of the outer axial wall 2.

To reinforce these cooling air films D1 and D2, the outer axial wall 2 and the inner axial wall 4 are each of the multi-perforated type, roughly over their full length. In other words, these walls 2 and 4 have many perforations 38, preferably each being cylindrical and with a circular section, and with a diameter of between about 0.3 and 0.6 mm.

Conventionally, and in a known manner, the perforations 38 are distributed all around the axial wall concerned and approximately all along the entire axial wall. Thus, it is actually possible to obtain air injection distributed over the entire surface of the axial wall, both circumferentially and longitudinally.

Still with reference to the single figure, it can be seen that the inner axial wall 4 is provided with a first zone 40 of perforations 38. This first zone 40, composed of circumferential rows of perforations 38 on the most upstream part of the wall 4, is designed such that the cooling air is introduced in reverse flow inside the cooling chamber 1, in order to enrich the cooling air film D1 originating from the chamber bottom end 8.

Thus, for each perforation 38 in the first zone 40, when considering an axial half-section like that shown in the single figure, the value of the angle A2 formed between a local direction 42 tangential to the inner axial wall 4 in this half-section, and a principal direction 44 of the perforation 38 in this same half-section, is between about 30° and 45°. In other words, and in more everyday language, each perforation 38 may be defined as making an angle of between about 30° and 45° with the inner axial wall 4.

Note that the first zone 40 is preferably composed of between 1 and 10 circumferential rows of perforations 38, these rows corresponding to the first upstream rows in the inner axial wall 4.

There is a second zone 46 of perforations 38 formed on the downstream side of the first zone 40 of perforations 38, formed such that the cooling air is introduced in co-current inside the combustion chamber 1.

In this second zone 46, each perforation 38 is formed such that, considering an axial half-section, the value of the angle A4 formed between a local direction 48 tangential to the inner axial wall 4 in this half-section, and a principal direction 50 of the perforation 38 in the same half-section, is between about 20° and 90°. Once again, in more everyday language, each perforation 38 may be defined as forming an angle between about 20° and 90° with the inner axial wall 4.

In the preferred embodiment described, the second zone 46 that is in the form of several circumferential rows of perforations 38, extends approximately as far as the downstream end of the inner wall 4.

Moreover, it is noted that the first and second zones 42 and 46 of the inner axial wall 4 are separated by a transition zone 52 of perforations 38, which are inclined such that, working from the upstream end to the downstream end, it is possible to change progressively from a cooling air flow with reverse current to a co-current cooling air flow.

Note that preferably, the transition zone 52 is formed from between 1 and 3 circumferential rows of perforations 38. As an illustrative example, the inclination of perforations 38 in this transition zone 52 can then vary progressively from −30° to 30°, working from the upstream side to the downstream side.

Similarly, it can be seen in the single figure that the outer axial wall 2 is provided with a first zone 54 of perforations 38. This first zone 54, formed by circumferential rows of perforations 38 located on the upstream side of the wall 2, is designed such that the cooling air is added in reverse current inside the cooling chamber 1, in order to enrich the cooling air film D2 originating from the chamber bottom end 8.

Thus, for each perforation 38 in the first zone 54, in the axial half-section as shown in the single figure, the value of the angle A1 formed between a local direction 56 tangential to the outer axial wall 2 in this half-section, and a principal direction 58 of perforation 38 in this same half-section, is between about 30° and 45°.

Note that preferably, the first zone 54 is composed of between 1 and 10 circumferential rows of perforations 38, these rows also corresponding to the first upstream rows of the outer axial wall 2.

On the downstream side of the first zone 54 of perforations 38, there is a second zone 60 of perforations 38 formed such that the cooling air is introduced flowing in the same direction inside the combustion chamber 1.

In this second zone 60, each perforation 38 is formed such that in a half-axial section, the value of the angle A3 formed between a local direction 62 tangential to the outer axial wall 2 in this half section, and a principal direction 64 of the perforation 38 in this same half-section, is between about 20° and 90°.

In the preferred embodiment described, the second zone 60 that is in the form of several circumferential rows of perforations 38, extends approximately to the downstream end of the inner wall 4.

Moreover, it is noted that the first and second zones 54 and 60 of the outer axial wall 2 are also separated by a transition zone 66 of perforations 38, which are inclined so as to progressively changing from a reverse current cooling air flow to a co-current cooling air flow, working from the upstream side to the downstream side.

Note that preferably, the transition zone 66 is composed of between 1 and 3 circumferential rows of perforations 38. For example, like the transition zone 52 in the inner wall 4, the inclination of the perforations 38 in this transition zone 66 can then vary progressively from −30° to 30°, from the upstream end to the downstream end.

Note that in the above description, the term << tangential local direction >> may denote a line approximately parallel to the two portions of straight lines symbolizing the wall in the axial half section, close to the perforation concerned.

Similarly, the term << principal direction of perforation >> may correspond to a line approximately parallel to the two straight-line segments symbolizing the perforation concerned, still in this same axial half-section. In this respect, note that the principal directions of the perforations 38 correspond to their main axes, in the case in which these perforations 38 are diametrically crossed by the section plane.

Preferably, a local zone 70 of perforations 38 is formed on the downstream side of each of the primary orifices 24 and dilution orifices 26. These local zones 70 are designed such that the cooling air is introduced locally in reverse current inside the combustion chamber 1. In this way, the perforations 38 in these local zones 70 are formed in approximately the same manner as described above for perforations 38 in the first zones 40 and 54.

However, unlike the first and second zones 40, 46, 54 and 60, and the transition zones 52 and 66, the local zones 70 do not extend all around the axial walls 2 and 4, but only over a restricted circumferential length. Moreover, the local zones 70 are not necessarily followed on the downstream side by transition zones gradually correcting the direction in which cooling air is introduced inside the combustion chamber 1.

For example, it could be planned that each local zone 70 of perforations 38 extends circumferentially over a length equal to between one and two times the diameter of the primary orifice 24 or the dilution orifice 26 on the downstream side of which it is located, and that each of these local zones 70 includes between one and five rows of perforations 38.

Obviously, it should be understood that the multi-perforation on the inner axial wall 4 and the outer axial wall 2 comprises all the perforations 38 that have just been described. Therefore these perforations 38 make it possible to benefit from a combination of the effects of reverse current injection and co-current injection, and consequently optimize the global cooling efficiency.

Moreover, as can be seen in the single figure, the deflector 14 of the pilot head 10 comprises a passage 72 through which part of the cooling air flow D is introduced inside the combustion chamber 1, close to the inter-heads wall 19.

In this manner, the passage 72 then enables the initiation of a cooling air flow D3 along the hot inner surface 74 of the inter-heads wall 19, which extends mainly in the axial direction.

Consequently, this inter-heads wall 19 is also of the multi-perforated type, and still with the objective of enriching this cooling air film D3.

Furthermore, in order to obtain very good temperature uniformity, the inter-heads wall 19 is provided with a first zone 76 of perforations 38 working from the upstream side to the downstream side, formed such that cooling air is introduced into the combustion chamber 1 in reverse current, from a transition zone 78 of perforations 38, and a second zone 80 of perforations 38 formed such that the co-current cooling air flow is introduced into the combustion chamber 1.

Obviously, those skilled in the art could make various modifications to the annular combustion chamber 1 that has just been described solely as a non-limitative example.

The invention claimed is:

1. An annular combustion chamber, said combustion chamber comprising an outer axial wall, an inner axial wall and a chamber bottom end connecting said outer and inner axial walls, the chamber bottom end being provided firstly with several injection orifices intended at least to inject fuel inside the combustion chamber, and secondly passages allowing at least an initiation of a first cooling air film along a hot inner surface of the outer axial wall and of a second cooling air film along a hot inner surface of the inner axial wall, said outer axial wall and inner axial wall being multi-perforated roughly over their full length in order to enable reinforcement of the first and second cooling air films, wherein said outer axial wall and inner axial wall are provided with a first zone of perforations in an upstream part, formed such that cooling air is introduced inside the combustion chamber toward an upstream side of said combustion chamber, wherein the chamber bottom end has an inter-heads wall provided, from the upstream side of the combustion chamber toward a downstream side of the combustion chamber, with a first zone of perforations formed such that cooling air is introduced toward said upstream side inside the combustion chamber, with a transition zone of perforations, and with a second zone of perforations formed such that a cooling air flow is introduced into said combustion chamber toward said downstream side of the combustion chamber.

2. An annular combustion chamber according to claim 1, wherein:

each perforation in the first zone of the outer axial wall is formed such that in an axial half-section, the value of an angle formed between a local direction tangential to the outer axial wall in said half-section, and a principal direction of the perforation in said half-section, is between about 30° and 45°, and each perforation in the first zone in the inner axial wall is formed such that in an axial half-section, the value of an angle formed between a local direction tangential to the inner axial wall in said half-section, and a principal direction of the perforation in said half-section, is between about 30° and 45°.

3. An annular combustion chamber according to claim 1, wherein the first zone of perforations in said outer axial wall and inner axial wall are composed of between 1 and 10 circumferential rows.

4. An annular combustion chamber according to claim 1, wherein said outer axial wall and inner axial wall are provided with a second zone of perforations downstream of the first zone of perforations, formed such that a current of cooling air is inserted inside the combustion chamber toward said downstream side of said combustion chamber.

5. An annular combustion chamber according to claim 4, wherein:

each perforation in the second zone in the outer axial wall is formed such that in an axial half-section, the value of an angle formed between a local direction tangential to the outer axial wall in said half-section, and a principal direction of the perforation in said half-section, is between about 20° and 90°, and each perforation in the second zone of the inner axial wall is formed such that in an axial half-section, the value of an angle formed between a local direction tangential to the inner axial wall in said half-section, and a principal direction of the perforation in this same half-section, is between about 20° and 90°.

6. An annular combustion chamber according to claim 5, wherein said outer axial wall and inner axial wall are provided with a transition zone of perforations between the first zone and the second zone of perforations.

7. An annular combustion chamber according to claim 6, wherein the transition zone of perforations in the outer axial wall and inner axial wall are composed of between 1 and 3 circumferential rows.

8. An annular combustion chamber according to claim 1, wherein the outer axial wall and the inner axial wall comprise several primary orifices and dilution orifices, a local zone of perforations formed such that cooling air is introduced locally inside the combustion chamber toward said upstream side of said combustion chamber, said local zone of perforations being formed downstream of said primary orifices, and downstream of each of said dilution orifices.

9. An annular combustion chamber according to claim 8, wherein each local zone of perforations extends circumferentially over a length equal to between one and two times the diameter of the primary orifices or the dilution orifices on a downstream side of which said local zone is located.

10. An annular combustion chamber, said combustion chamber comprising an outer axial wall, an inner axial wall and a chamber bottom end connecting said outer and inner axial walls, the chamber bottom end being provided firstly with several fuel injection orifices intended at least to inject fuel inside the combustion chamber, and secondly passages allowing at least an initiation of a first cooling air film along a hot inner surface of the outer axial wall and of a second cooling air film along a hot inner surface of the inner axial wall, said outer axial wall and inner axial wall being multi-perforated roughly over their full length in order to enable reinforcement of the first and second cooling air films, wherein said outer axial wall and inner axial wall are provided with a first zone of perforations in an upstream part, formed such that cooling air is introduced inside the combustion chamber toward an upstream side of said combustion chamber, wherein the outer axial wall and the inner axial wall comprise several primary orifices and dilution orifices, a local zone of perforations formed such that cooling air is introduced locally inside the combustion chamber toward said upstream side of said combustion chamber, said local zone of perforations being formed downstream of said primary orifices, and downstream of each of said dilution orifices.

11. An annular combustion chamber according to claim 10, wherein each local zone of perforations extends circumferentially over a length equal to between one and two times the diameter of the primary orifices or the dilution orifices on a downstream side of which said local zone is located.

12. An annular combustion chamber according to claim 10, wherein:

each perforation in the first zone of the outer axial wall is formed such that in an axial half-section, the value of an angle formed between a local direction tangential to the outer axial wall in said half-section, and a principal direction of the perforation in said half-section, is between about 30° and 45°, and each perforation in the first zone in the inner axial wall is formed such that in an axial half-section, the value of an angle formed between a local direction tangential to the inner axial wall in said half-section, and a principal direction of the perforation in said half-section, is between about 30° and 45°.

13. An annular combustion chamber according to claim 10, wherein the first zone of perforations in said outer axial wall and inner axial wall are composed of between 1 and 10 circumferential rows.

14. An annular combustion chamber according to claim 10, wherein said outer axial wall and inner axial wall are provided with a second zone of perforations downstream of the first zone of perforations, formed such that a current of cooling air is inserted inside the combustion chamber toward said downstream side of said combustion chamber.

15. A combustion chamber comprising:

an outer axial wall;

an inner axial wall; and a chamber bottom end between said outer axial wall and said inner axial wall, the chamber bottom end defining fuel injection orifices, and passages configured to form an air film along at least a portion of an inner surface of the outer axial wall and an air film along at least a portion of an inner surface of the inner axial wall, wherein the chamber bottom end has an inter-heads wall defining a first zone of perforations configured to introduce air inside the combustion chamber toward an upstream side of the combustion chamber.

16. An annular combustion chamber according to claim 15, wherein said inter-heads wall of said chamber bottom end defines a second zone of perforations configured to introduce air inside the combustion chamber toward a downstream side of the combustion chamber.

17. An annular combustion chamber according to claim 16, wherein said inter-heads wall of said chamber bottom end defines a transition zone of perforations between said first and second zones of perforations.

18. An annular combustion chamber according to claim 17, wherein said outer axial wall defines a zone of perforations configured to introduce air inside the combustion chamber toward an upstream side of the combustion chamber.

19. An annular combustion chamber according to claim 18, wherein said inner axial wall defines an a zone of perforations configured to introduce air inside the combustion chamber toward an upstream side of the combustion chamber.

20. An annular combustion chamber according to claim 15, wherein each of said perforations in said first zone is inclined, from an air intake of said perforation to an output of said perforation at said combustion chamber, toward said upstream side of the combustion chamber.

* * * * *